US006742433B2

(12) United States Patent
Smith et al.

(10) Patent No.: US 6,742,433 B2
(45) Date of Patent: Jun. 1, 2004

(54) LAUNCHER PLATFORM

(75) Inventors: Joseph P. Smith, Lowell, MA (US); John K. Coolidge, Colchester, VT (US); Stanley G. Turner, Monkton, VT (US)

(73) Assignees: Raytheon Company, Waltham, MA (US); General Dynamics Armament and Technical Products, Inc., Charlotte, NC (US)

( * ) Notice: Subject to any disclaimer, the term of this patent is extended or adjusted under 35 U.S.C. 154(b) by 0 days.

(21) Appl. No.: 09/976,389

(22) Filed: Oct. 12, 2001

(65) Prior Publication Data

US 2004/0069136 A1 Apr. 15, 2004

(51) Int. Cl.[7] ..... F41F 3/04
(52) U.S. Cl. ..... 89/1.815; 89/1.804
(58) Field of Search ..... 89/37.01–44.02, 89/1.51, 1.56, 1.59, 1.804, 1.8–1.82

(56) References Cited

U.S. PATENT DOCUMENTS 3,865,009 A * 2/1975 Kongelbeck ..... 89/1.815
4,470,336 A * 9/1984 Swann et al. ..... 89/1.815
4,637,292 A * 1/1987 Peterson ..... 89/1.804
4,697,764 A * 10/1987 Hardy et al. ..... 244/137.4
5,148,734 A * 9/1992 Lilly ..... 89/1.815
5,229,538 A * 7/1993 McGlynn et al. ..... 89/1.56
5,614,896 A * 3/1997 Monk et al. ..... 324/158.1
5,950,372 A * 9/1999 Al-Sabah et al. ..... 52/66
6,543,328 B1 * 4/2003 Plummer et al. ..... 89/1.54

OTHER PUBLICATIONS

FAS Military Analysis Network: Brimstone (Mar. 1999).*
Boeing Brimstone article (http://www.boeing.com/defense–space/missiles/brimstone/brimstone.htm), Feb. 2002.*
Brimstone/mounting rail pictures (http://stormpages.com/attila2/repullo/b6.jpg, (no date).*
Defense Systems Daily (http://defence–data.com/dubai2000/d2paged38.htm, Nov. 17, 1999.*
Defense Procurement Agency (http://www.mod.uk/dpa/projects/Brimstone.htm, May 2001.*
FAS Military Analysis Network (http://www.fas.org/man/dod–101/sys/missile/aim–120.htm, (no date).*
MDBA/Boeing Brimston (http://www.eurofighter.starstreak.net/common/AG/brimstone.html (no date).*

* cited by examiner

*Primary Examiner*—Michael J. Carone
*Assistant Examiner*—Troy Chambers
(74) *Attorney, Agent, or Firm*—Iandiorio & Teska

(57) ABSTRACT

A launcher platform including a support structure and a number of rails mounted on the support structure for supporting missiles thereon, each adjacent rail elevated above the other rails to accommodate additional missiles and different type missiles while maintaining low center of gravity.

35 Claims, 15 Drawing Sheets

LAUNCHER PLATFORM

FIELD OF THE INVENTION

This invention relates to a launcher platform and, in one specific embodiment, a launcher platform mounted on a vehicle such as a military HMMWV ("HUM-V") vehicle and equipped with advanced medium range air-to-air missiles ("AMRAAMs").

BACKGROUND OF THE INVENTION

Firepower and mobility are two key features of the United States military's air defense system. Unfortunately, there are tradeoffs between mobility and firepower: the greater the firepower, the more missiles that are required; the higher the number of missiles, the less achievable mobility.

In one prior art weapon system, four AMRAAM model AIM-120 A, B, or C missiles were mounted on rails on a launcher platform which, in turn, was mounted on a military HUM-V vehicle. Once driven to a strategic position, the launcher platform is elevated and/or rotated and the missiles fired. Such a system, however, did not exhibit the maximum firepower since it was limited to only four missiles.

Moreover, the AIM-120C model missile is only one of four current models of AMRAAM style missiles. Other models include the AIM-120A, the AIM-120B, and the extended range version of the AMRAAM. And, these different model missiles have different size fins. The fins of the AIM-120C missile, for example, occupy an imaginary box 12.4 inches square while, in contrast, the fins of the AIM-120A and AIM-120B, and extended range missiles occupy a 17.44 inch square box.

But, not all military divisions currently have a uniform complement of missiles. The United States Marine Corps, for example, has both the AIM-120C and the AIM-120B models in inventory. Unfortunately, some prior art launcher platforms were not specifically designed or configured to accept, at one time, both AIM-120C and AIM-120B model missiles.

Moreover, there are very tight military specifications concerning the weight, length, and width of the launcher platform. For example, the launcher platform for the HUM-V vehicle must be less than 86 inches in width so that it does not interfere with anything as the HUM-V vehicle travels to a launch site and also so that the HUM-V vehicle can be loaded into a C-130 transport aircraft with the launch platform and missiles in place. The length of the launch platform, in turn, must not extend forward of the vehicle's bumper nor rear of the vehicle's tow bar. Also, individual missiles weigh as much as 350 pounds. Thus, the weight of the launcher platform must be kept to a minimum so that the launch platform and the missiles can be air lifted easily. Moreover, the center of gravity of the platform with the missiles in place thereon must be as low as possible—again to insure the mobility requirements of the HUM-V transport vehicle are not adversely affected.

As stated above, the fins of the AIM-120A and AIM-120B missiles occupy a box almost 18 inches square. Were five of these missiles placed in-line on the platform, they would occupy 90 inches. Adequate space on the order of about 1-inch between adjacent missiles is also required and another 5 inches is required for the erectable antenna mast centrally located on the missile support platform. Thus, the total is 99 inches. Such an orientation clearly exceeds the 86 inch width requirement. Moreover, if the missiles were placed side by side on the platform, it would be difficult or near impossible for military personal to correctly install the fins on the missiles.

SUMMARY OF THE INVENTION

It is therefore an object of this invention to provide a more versatile launcher support platform.

It is a further object of this invention to provide such a launcher platform which can accommodate additional missiles.

It is a further object of this invention to provide such a launcher platform which can accommodate different model missiles.

It is a further object of this invention to provide such a launcher platform which has a low center of gravity.

It is a further object of this invention to provide such a launcher platform which meets certain predefined weight, width, and length requirements.

It is a further object of this invention to provide such a launcher platform which, in one specific embodiment, can accommodate two AIM-120A or AIM-120B model missiles and three AIM-120C model missiles.

It is a further object of this invention to provide such a launcher platform which, in one specific embodiment, can accommodate six AIM-120C model missiles.

It is a further object of this invention to provide such a launcher platform which, in one specific embodiment, can accommodate four AIM-120A or AIM-120B model missiles.

It is a further object of this invention to provide such a launcher support platform which, in one specific embodiment, can accommodate four extended range AMRAAM missiles.

It is a further object of this invention to provide such a launcher support platform which does not interfere with the launch vehicle's mobility or interfere with the launch vehicle when the launch platform is elevated and/or rotated.

It is a further object of this invention to provide such a launcher support platform which facilitate easy installation of the fins on the missiles.

It is a further object of this invention to provide such a launcher platform which is monolithic in construction and reliably produced by casting techniques.

It is a further object of this invention to provide such a launcher platform which exhibits the flexibility to install various combinations of missile types.

The invention results from the realization that a launcher platform which can accommodate additional missiles and thus supports a higher fire power capability and which can also accommodate missiles of different configurations and yet which does not affect launch vehicle mobility and maintains a low center of gravity and meets certain predefined weight, width, and length requirements can be effected by elevating the intermediate rails on the platform above the rails adjacent to them to a height where the fins of the missiles on the rails are interleaved and also by offsetting the elevated rails rearwardly so that the fins can be installed more easily on the missiles and also so that the fins of the two outer missiles do not interfere with anything as the launcher platform is elevated and/or rotated.

One design goal of the preferred embodiment is to accommodate as many AIM-120C model missiles as possible (e.g., six at fixed sites or during low mobility requirements and five during high mobility requirements) since, in the future, these types of missiles will be the most prevalent and yet to also accommodate as many AIM-120A and/or AIM-120B style missiles as possible (in some cases in conjunction with AIM-120C and/or extended range missiles) since divisions such as the United State Marine Corps still have these model missiles in inventory.

In the specific design of the preferred embodiment, the total width occupied by the six AIM-120C missiles is only 80 inches—well below the 86 inch maximum width requirement and a great improvement over the prior art which was limited to only four AIM-120C missiles.

This invention features a launcher platform comprising a support structure and a plurality of rails mounted on the support structure for supporting missiles thereon. Each adjacent rail is preferably elevated above the other rails to accommodate additional missiles and different type missiles while maintaining a low center of gravity.

In the preferred embodiment, there are six rails total, three on each side of the support structure, and the intermediate rails on each side are elevated above the other rails. In other embodiments, there are N total rails where N is an even number, N/2 rails on each side of the support structure, and the minority of the rails are elevated.

In the preferred embodiment, the adjacent rails are also offset rearwardly from the other rails. Typically, it is the elevated rails which are offset rearwardly from the other rails. If there are six rails total, three on each side of the support structure, the intermediate rails on each side are elevated above and offset rearwardly from the other rails. In other embodiments, there are N rails total where N is an even number, N/2 rails on each side of the support structure, and the minority of the rails are offset rearwardly from the other rails.

In the preferred embodiment, the support structure is a monolithic platform and includes a set of mounting pads for each rail. Typically, the mounting pads are cast as a part of the platform. To meet certain military requirements, the platform typically has a predetermined width and a predefined length.

In the preferred embodiment, the platform is made of aluminum or a composite material. Typically, the rails are symmetrically arranged with respect to the center line of the platform.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
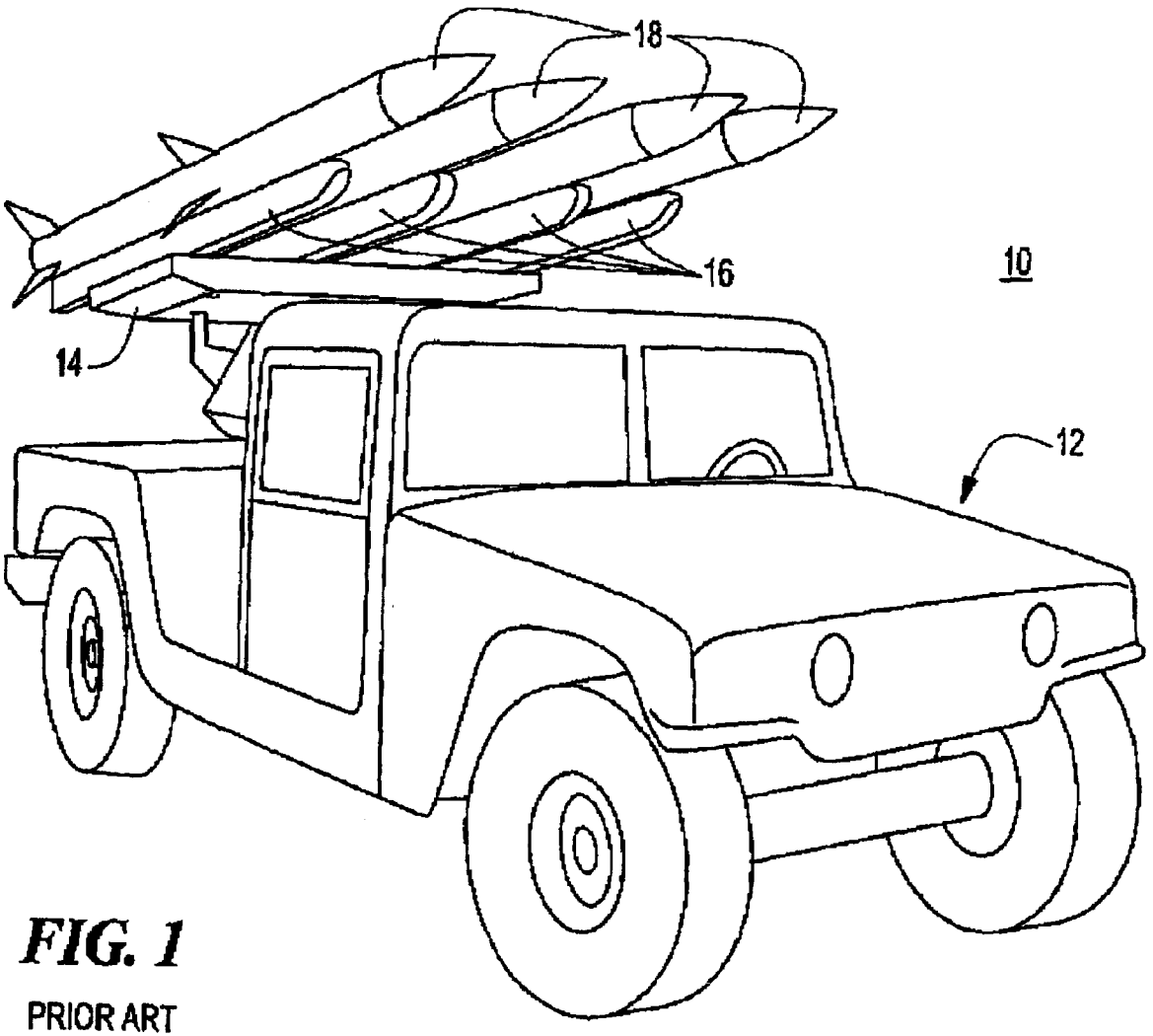
FIG. 1 PRIOR ART
FIG. 1 is a schematic view of a prior art weapon system with four missiles mounted on a HUM-V vehicle.
Figure 2:
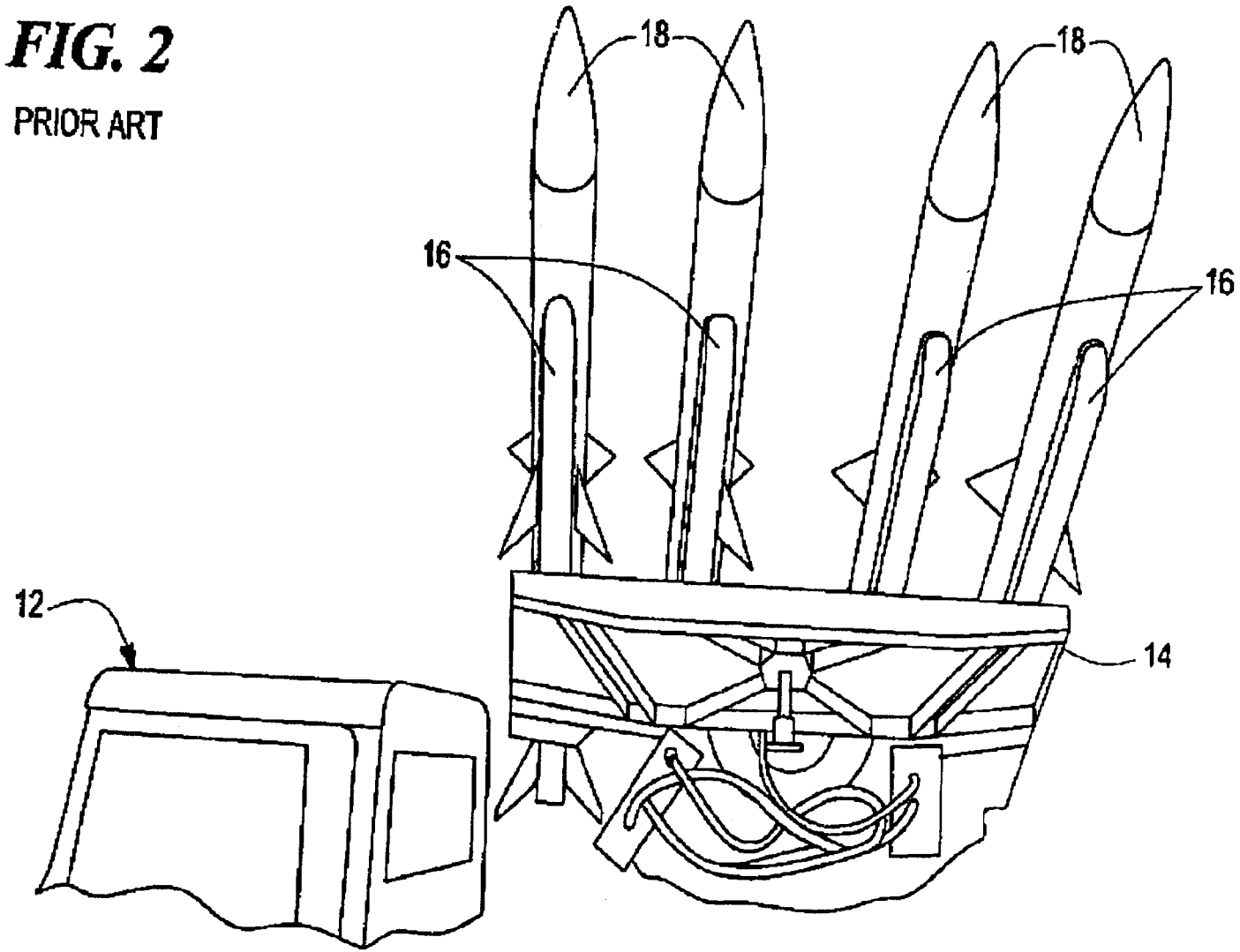
FIG. 2 PRIOR ART
FIG. 2 is a another schematic view of the prior art weapon system shown in FIG. 1 with the missiles in position ready for launch.

Prior art weapon system 10, FIGS. 1 and 2 includes HUM-V vehicle 12 and launcher platform 14 mounted thereon. Four rails 16 are fixed on platform 14 and four AIM-120A, AIM-120B, or AIM-120C missiles 18, one per rail, are mounted thereon. FIG. 1 shows the position of platform 14 when vehicle 12 is in the transport mode while FIG. 2 depicts how platform 12 can be elevated and/or rotated when vehicle 12 is stationary and in the launch mode.

As delineated in the Background of the Invention section above, system 10, FIGS. 1 and 2 could only accommodate four missiles within the maximum width (86 inch) military requirement. System 10 could accommodate mixtures of the four different AMRAAM missile models: the AIM-120A, the AIM-120B, the AIM-120C, and the extended range version of the AMRAAM missile, but only in total quantities of four at a time.

Figure 3:
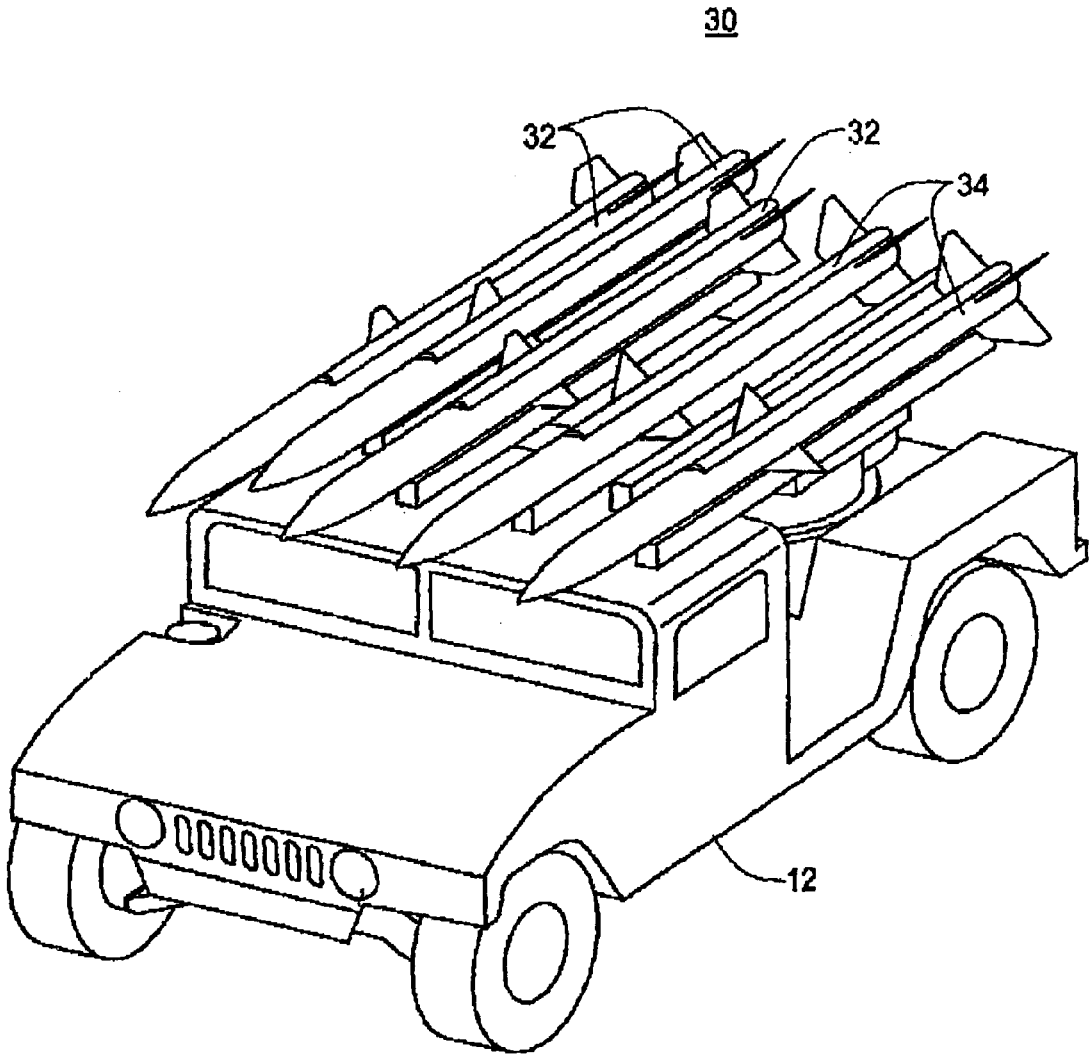
FIG. 3 is a schematic view of the weapon system of the subject invention shown with three AIM-120C and two AIM-120A or B missiles mounted on a HUM-V vehicle.
Figure 4:
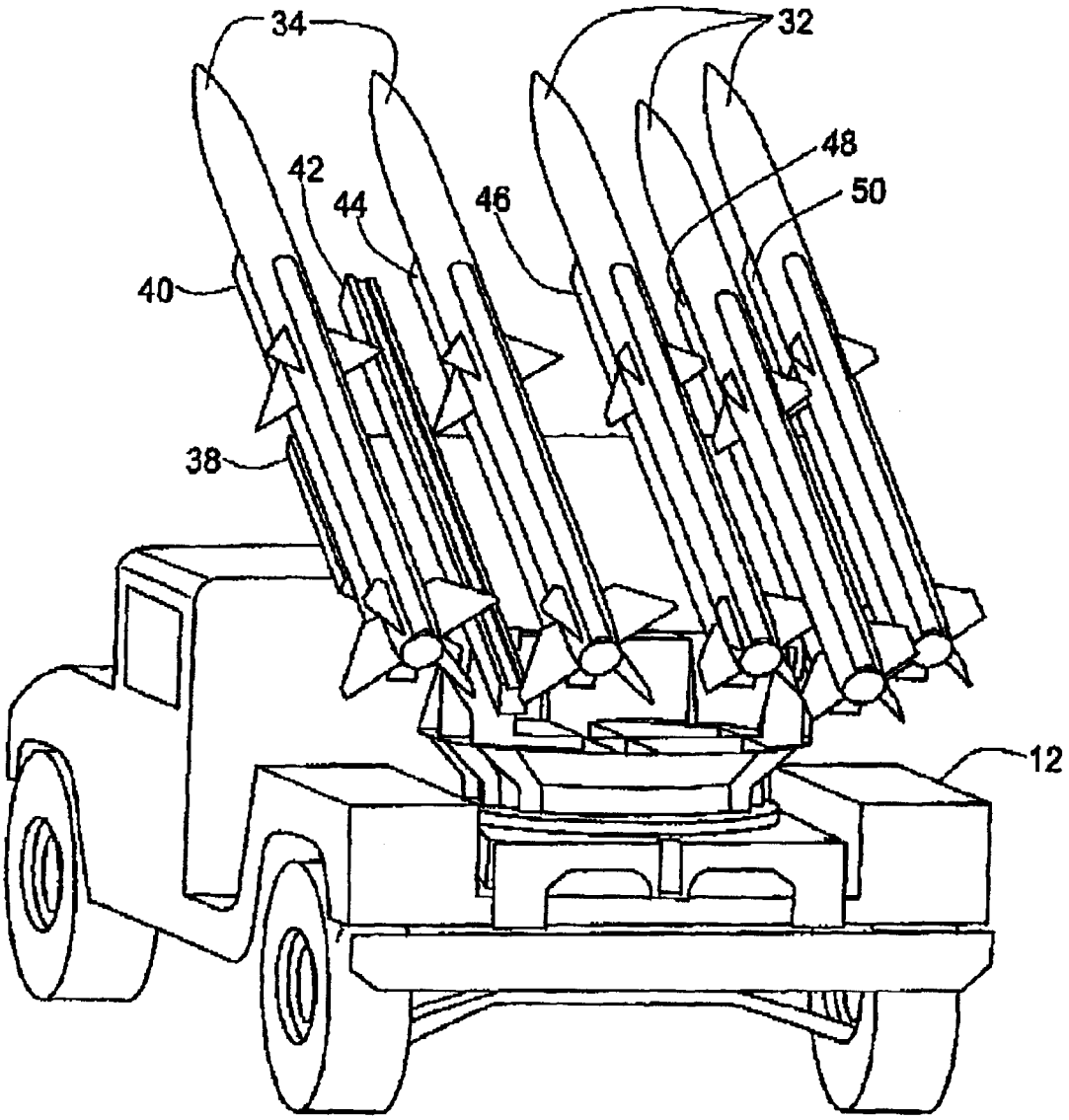
FIG. 4 is another schematic view showing the weapon system of FIG. 3 when the missiles are in the launch position.
Figure 5:
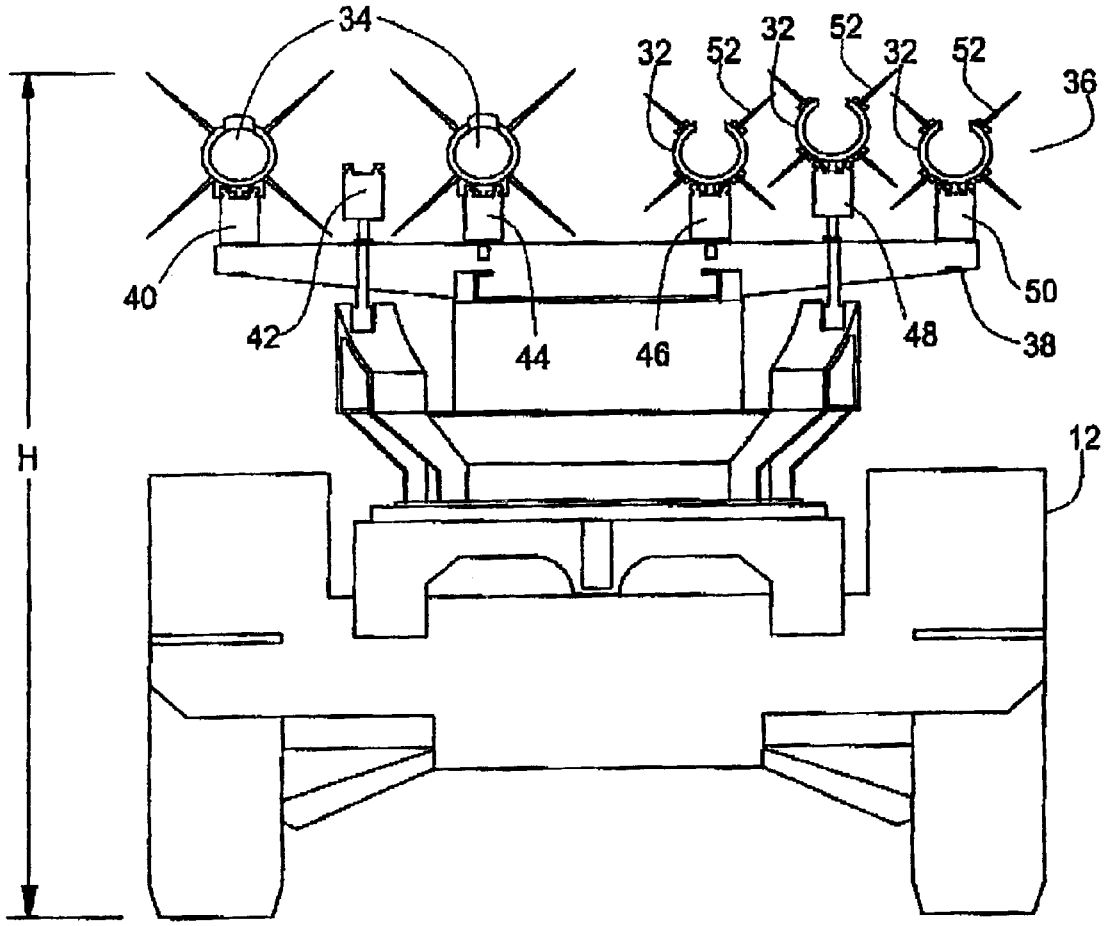
FIG. 5 is another schematic view showing the weapon system of FIGS. 3 and 4 from the rear.

In sharp contrast, weapon system 30, FIGS. 3–5, of the subject invention can accommodate three AIM-120C missiles 32 and two AIM-120A or AIM-120B missiles 34. As shown best in FIG. 5, launcher platform 36 mounted on vehicle 12 includes support structure 38 which, in the preferred embodiment, is a monolithic aluminum platform 71.12 inches wide and 49.08 inches long. Rails 40, 42, 44, 46, 48, and 50 are mounted lengthwise on platform 38 for supporting the missiles thereon. Intermediate rails 42 and 48 on each side of platform 38 are elevated above adjacent rails 40 and 44 and rails 46 and 50 as shown.

In this way, the fins 52 of AIM-120C missiles 32 are interleaved as shown. At the same time, the center of gravity of the launcher is kept as low as possible. Depending on the type and weight of the missiles, rails 40, 44, and 46, 50 could be elevated above rails 42 and 48 but then the center of gravity would be raised. Therefore, in the preferred embodiment, the system is symmetrical and there are N rails total (here 6); N/2 rails (here 3) on each side of the platform, and the minority of the rails on each side (here 1) are elevated to keep the center of gravity as low as possible.

As shown most clearly in FIG. 4, intermediate elevated rails 42 and 48 are also offset rearwardly from the other rails. This feature allows the fins to be more easily installed on the missiles and also insures the fins of the outer two missiles do not interfere with anything as platform 38 is elevated and rotated. In this preferred design, the total height from the ground to the top of the fins is 90.0 inches when AIM-120C missiles are installed on rails 40 and 50 and 90.7 inches when an AIM-120A or AIM-120B missiles are installed on rail 40 or rail 50.

Figure 6:
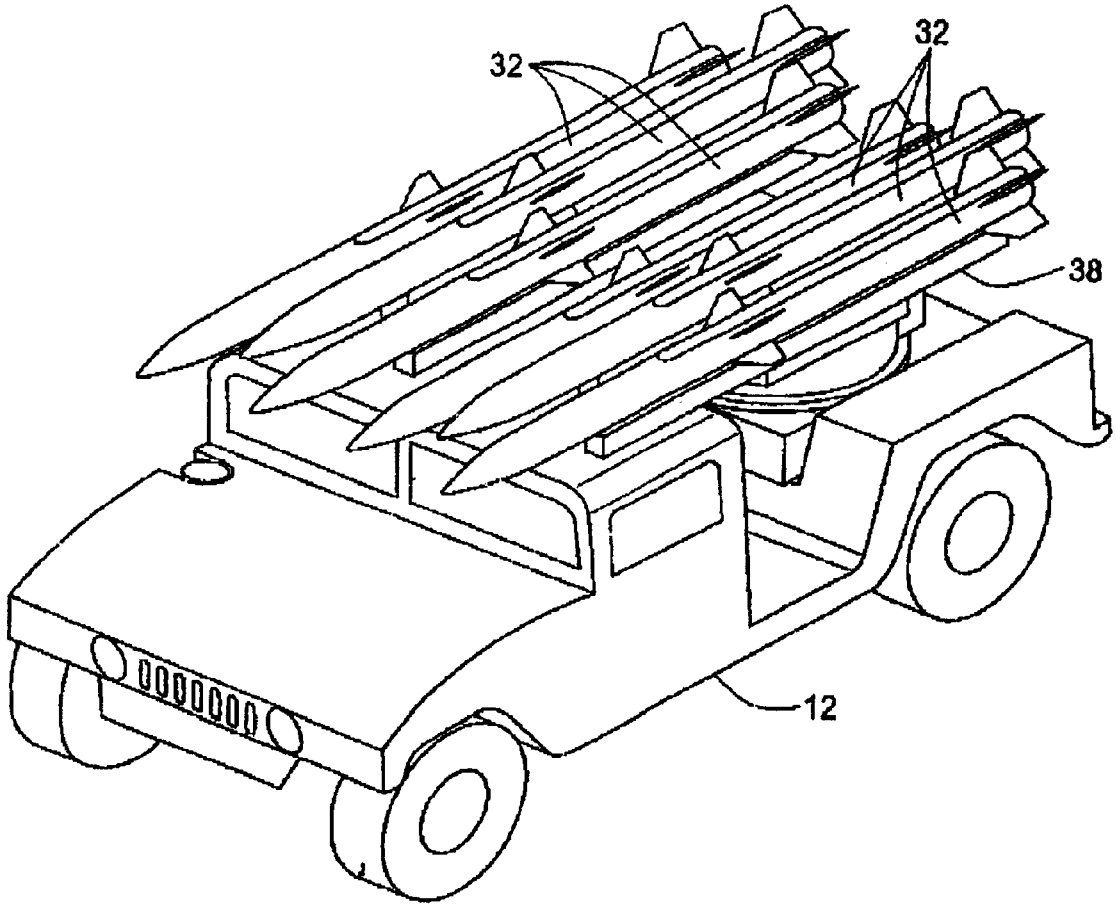
FIG. 6 is a schematic view showing the weapon system of the subject invention wherein six AIM-120C model missiles are mounted on a HUM-V vehicle.
Figure 7:
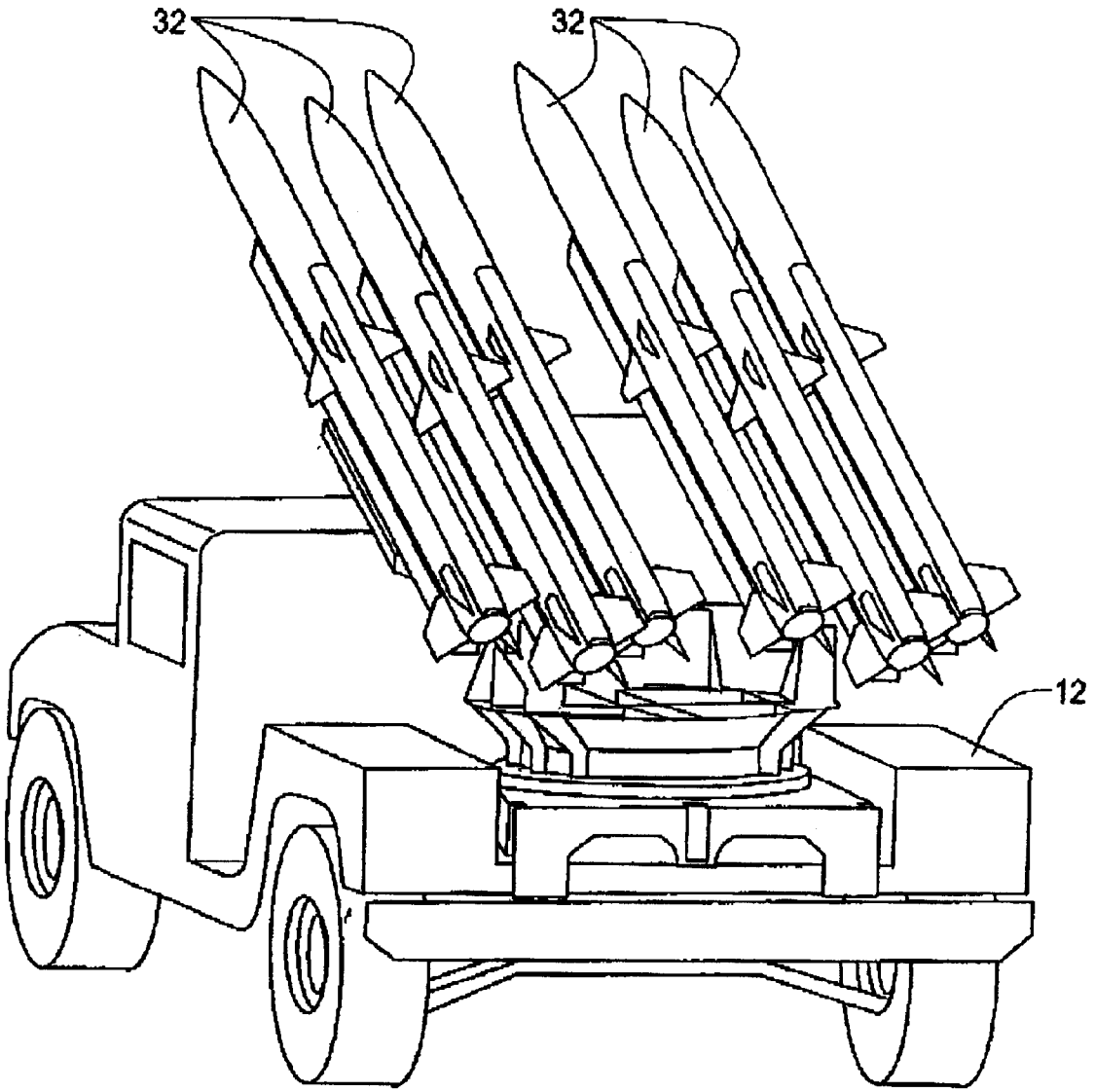
FIG. 7 is a view similar to FIG. 6 except now the missiles are in the launch position.
Figure 8:
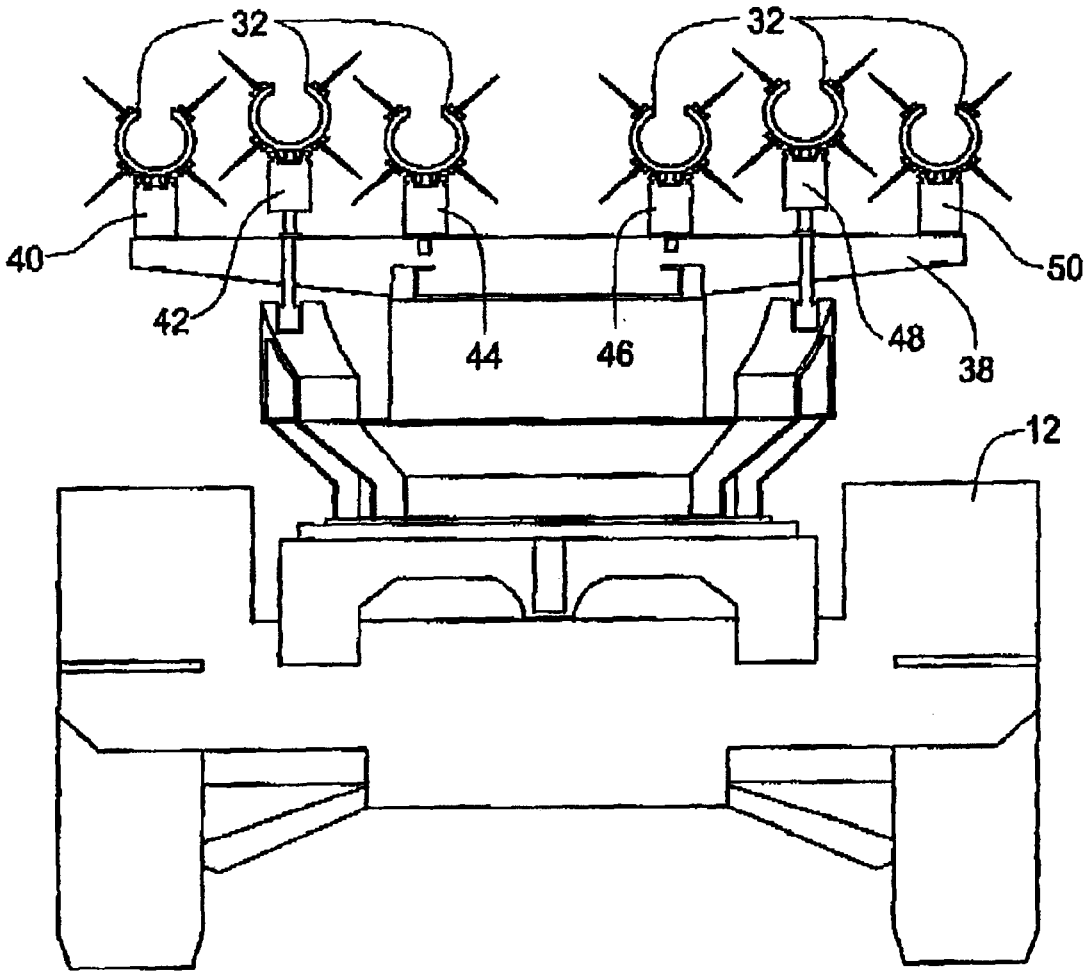
FIG. 8 is a view of the rear of the weapon system shown in FIGS. 6 and 7.

As shown in FIGS. 6–8, the same launcher platform system can accommodate 6 AIM-120C missiles 32 and still provide 1.3 inches of fins spacing between adjacent missiles since intermediate rails 42 and 48 are elevated above adjacent rails 40 and 44 and rails 46 and 50. Typically, however, only five AIM-120C missiles are mounted on platform 38 when vehicle 12 is in motion and the sixth AIM-120C missile is loaded when vehicle 12 is at or near the launch position.

Figure 9:
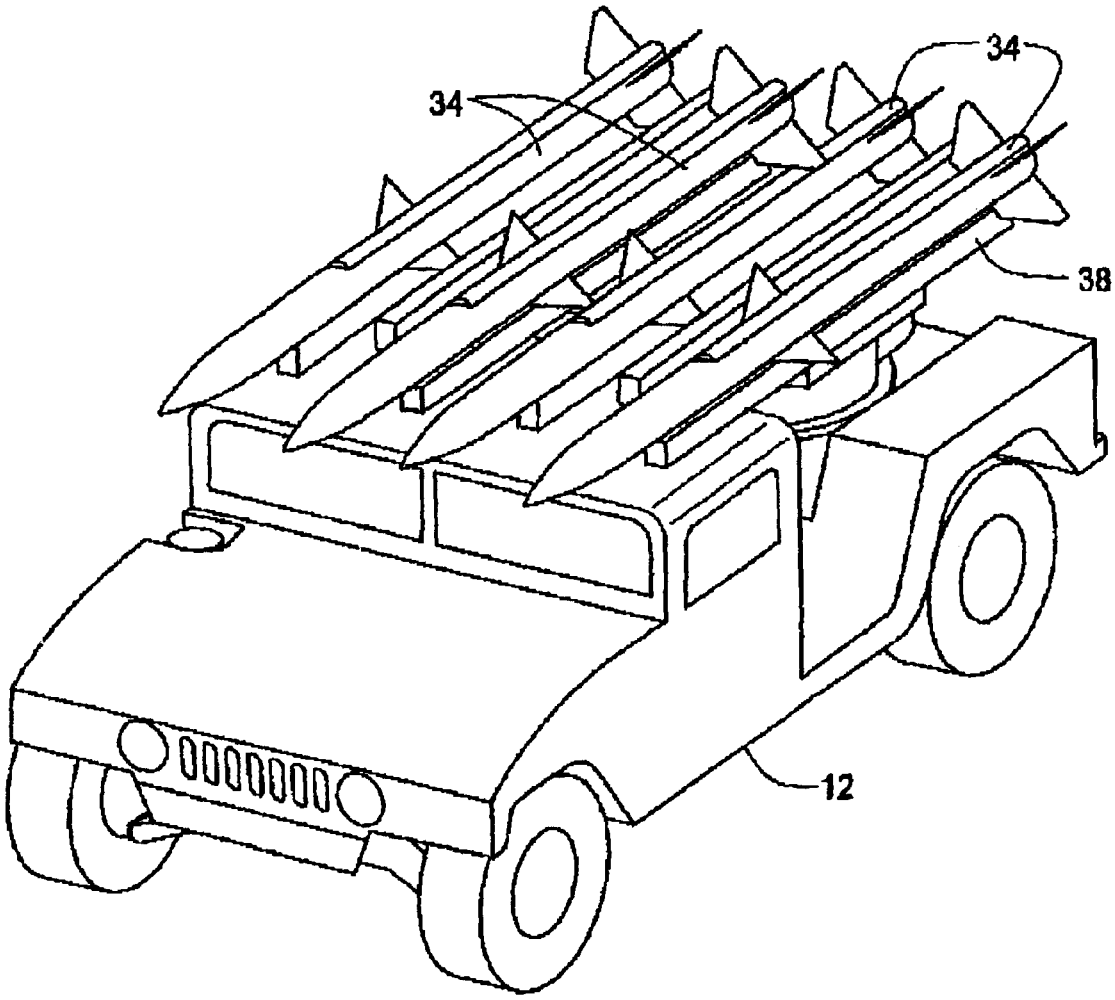
FIG. 9 is a schematic view of the weapon system of the subject invention wherein four AIM-120A or AIM-120B style missiles are mounted on a HUM-V vehicle.
Figure 10:
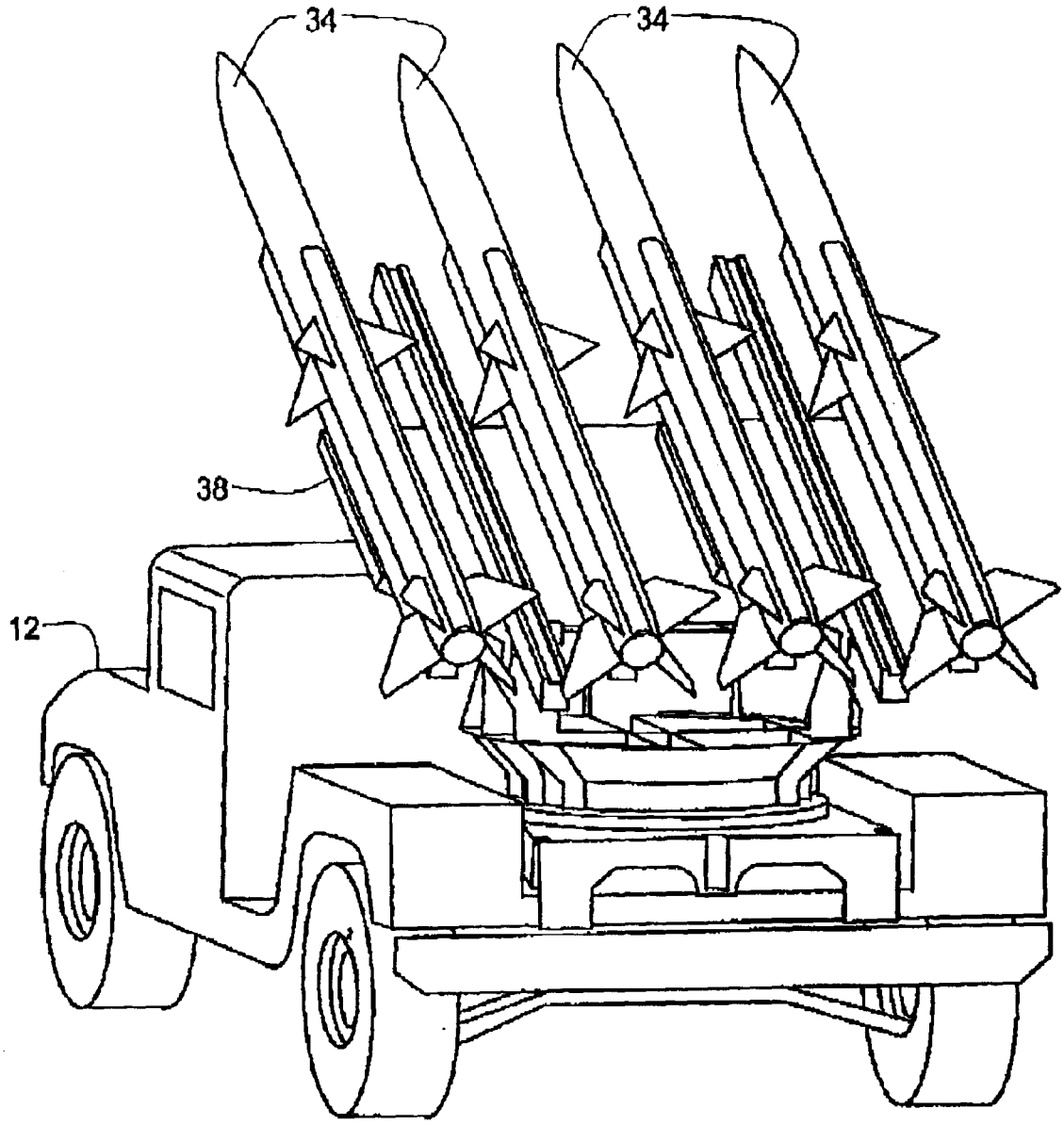
FIG. 10 is view similar to FIG. 9 except now the missiles are shown in the launch position.
Figure 11:
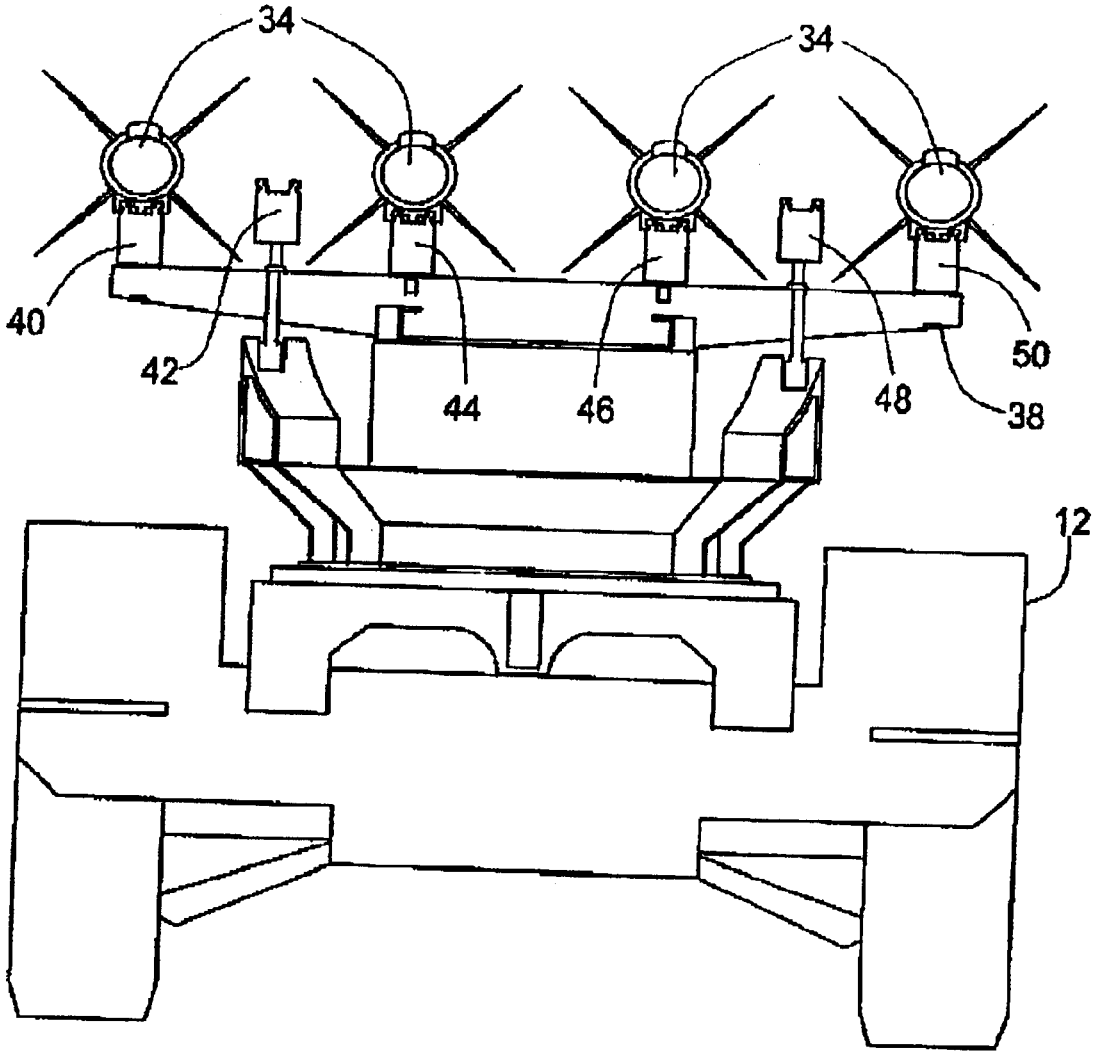
FIG. 11 is a view showing the rear of the weapon system shown in FIGS. 9 and 10.

As shown in FIGS. 9–11, the same launcher platform system can accommodate four AIM-120A or AIM-120B missiles 34 and intermediate rails 42 and 48 are not loaded with missiles since the fins of these style missiles are longer and since a four inch space must be left in the center of platform 38 to accommodate the data link antenna (DLA) subsystem.

Figure 12:
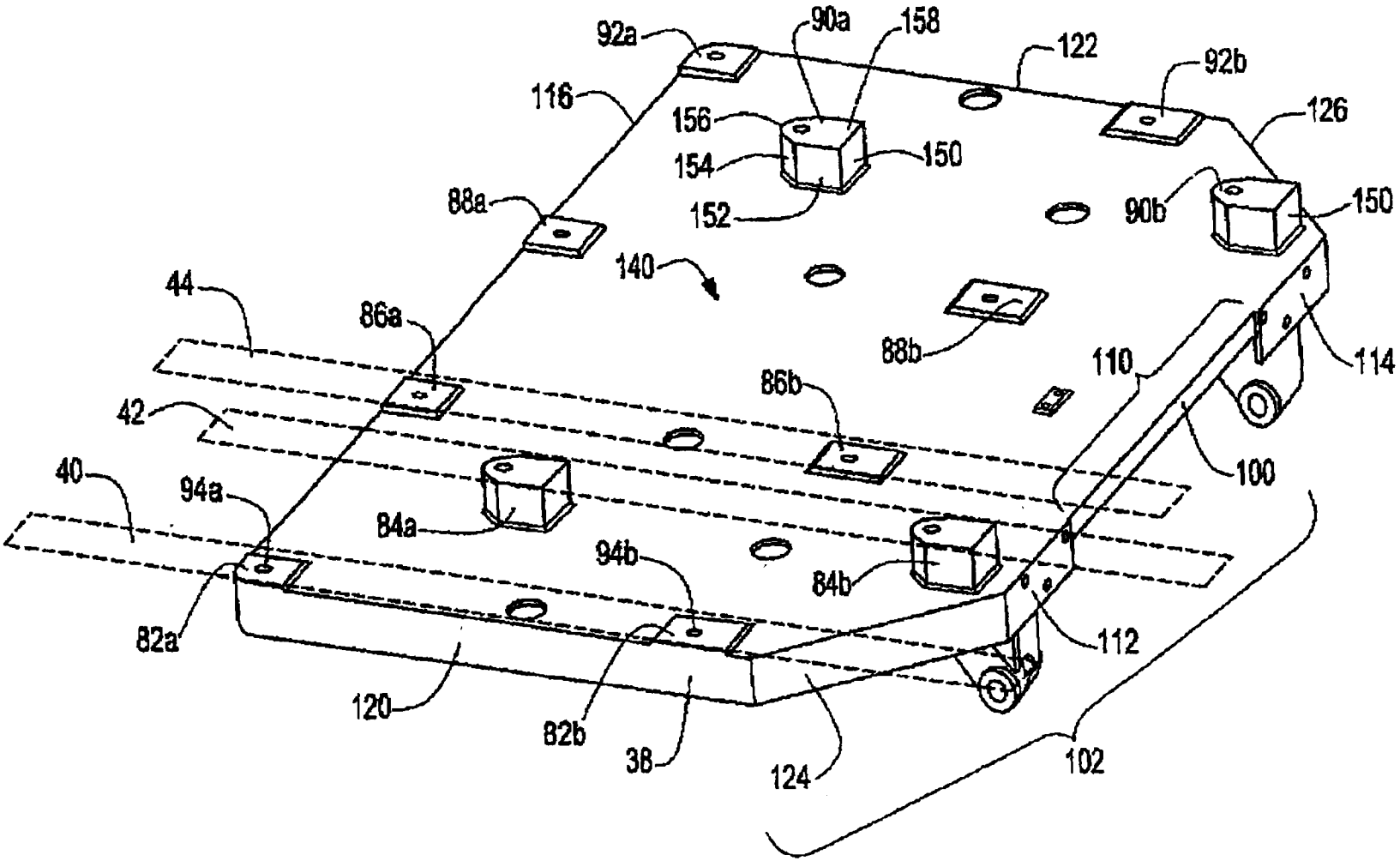
FIG. 12 is a schematic view showing the top of the launcher platform of the subject invention for the weapon systems shown in FIGS. 3–11.
Figure 13:
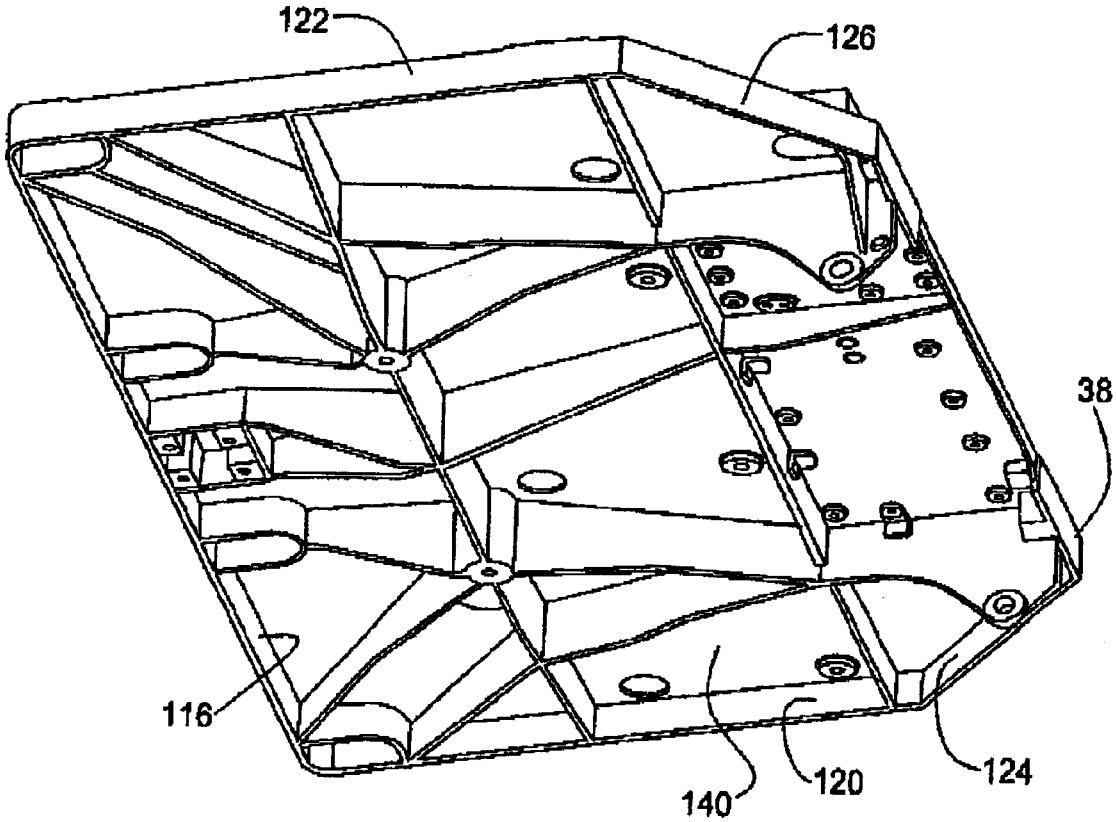
FIG. 13 is a view of the bottom of the launcher platform shown in FIG. 12.

Platform 38, FIGS. 12–13 is preferably cast as a single piece of aluminum 72.12 inches wide and 48.67 inches long. Rail mounting pads 82*a*, 82*b*; 84*a*, 84*b*; 86*a*, 86*b*; 88*a*, 88*b*; 90*a*, 90*b*; and 92*a*, 92*b* are cast as a part of platform 38. Platform 38 could also be made of composite materials including plies of fiber reinforced material in a resin matrix. Intermediate mounting pad sets 84*a* and 84*b* and 90*a* and 90*b* are elevated 2.5 inches above adjacent pad sets 82*a* and 82*b* and 86*a*, 86*b*, and 88*a*, 88*b* and 92*a*, 92*b* to position the intermediate rails higher than the rails adjacent them as discussed above. Thus, rail 40, FIG. 11 is mounted to mounting pads 82*a*, 82*b*, FIG. 12 through bolt holes 94*a* and 94*b*; rail 42, FIG. 11 is mounted to mounting pads 84*a*, 84*b*, FIG. 12 in a similar fashion, and rail 44, FIG. 11 is mounted to mounting pads 86*a*, 86*b*, FIG. 12. Rails 46, 48, and 50, FIG. 11, are mounted on mounting pad sets 88*a*, 88*b*; 90*a*, 90*b*; and 92*a* and 92*b*, FIG. 12, respectively.

Rails 40, 42, 44, 46, 48, and 50 are all typically the same lengths (e.g., 100.76 inches) so they do not have to be specially machined. But, by setting intermediate mounting pad sets 84*a*, 84*b* and 90*a*, 90*b* 11½ inches rearward of the pad sets adjacent them, intermediate rails 42 and 48, FIG. 11 and the ends of any corresponding missiles mounted thereon are also offset rearwardly from the missiles adjacent them by 11½ inches.

Figure 14:
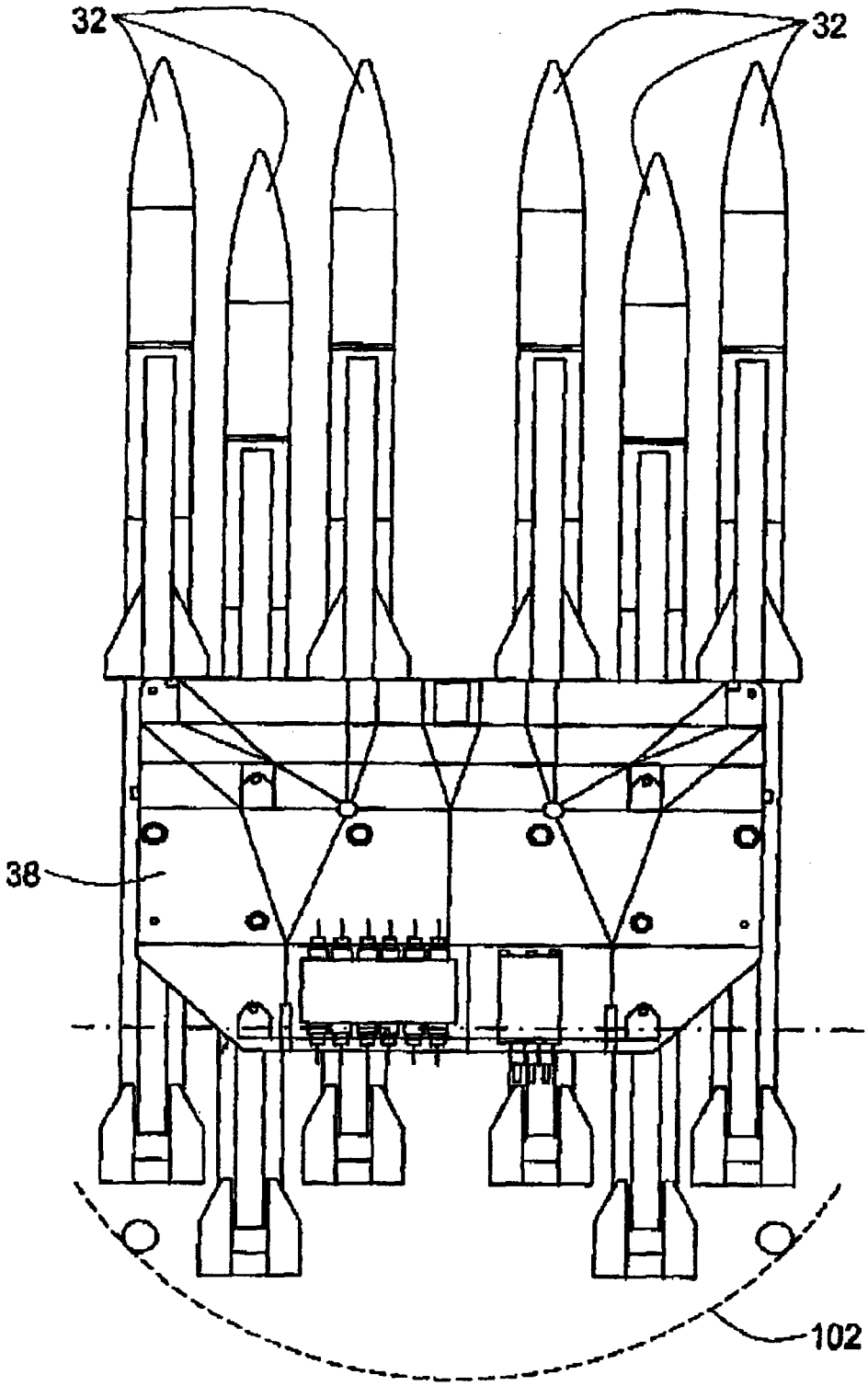
FIG. 14 is a bottom view of the launcher platform shown in FIGS. 12 and 13 with six AIM-120C type missiles loaded thereon.

In FIG. 12, only rails 40, 42, and 44 are shown in phantom. Rail 42 extends 21.96 inches from rear end wall 100 of platform 38. Rails 40 and 44 extend 10.46 inches from rear end wall 100 of platform 38. The rear ends of the missiles extend 5.86 inches out from the end of each rail. This configuration defines a suitable dynamic sweep envelope as shown at 102 in FIG. 12 and FIG. 14 which insures that the fins of the outer most missiles do not interfere with anything when platform 38 is raised and/or rotated.

Figure 15:
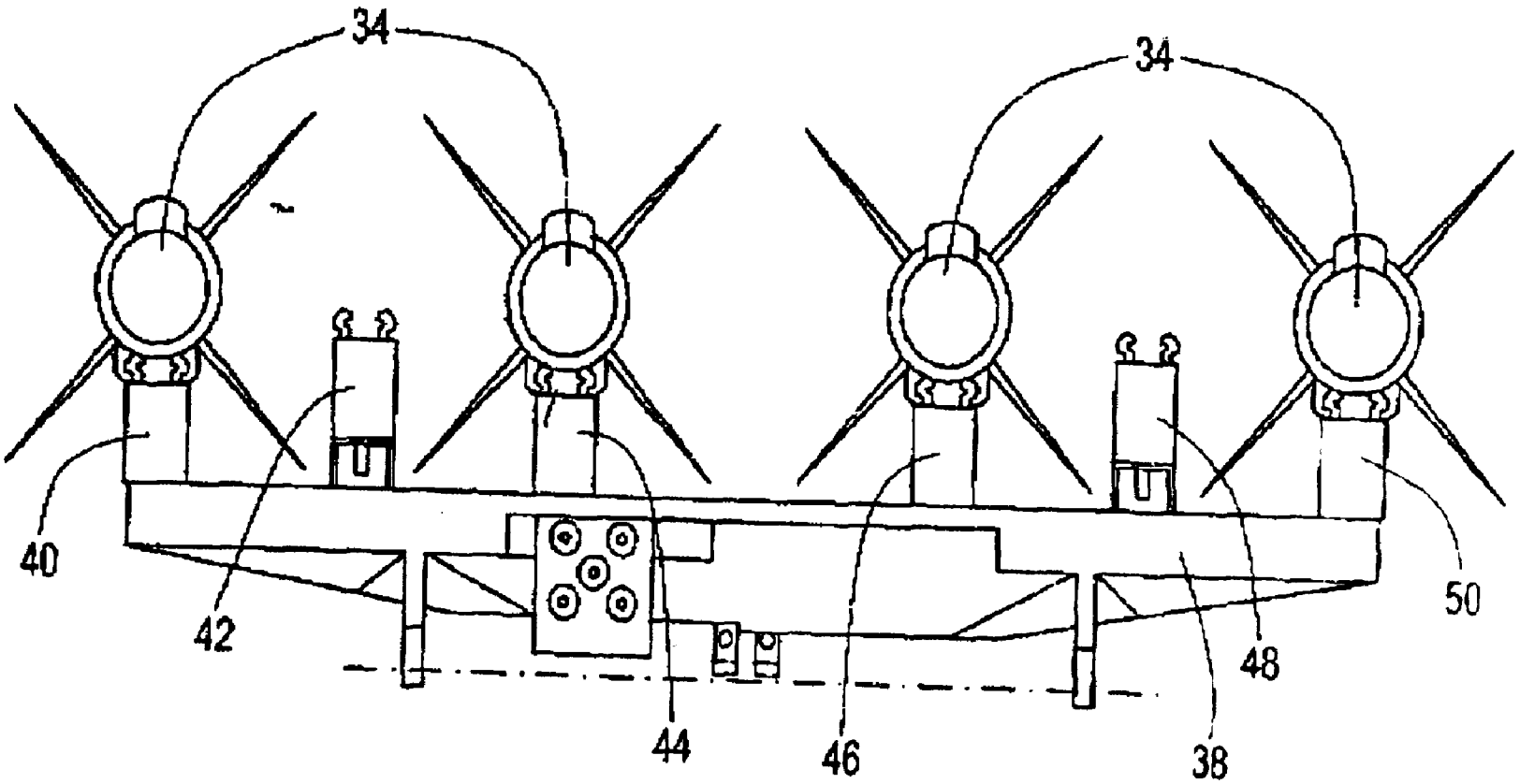
FIG. 15 is a rear view of the launcher platform shown in FIGS. 12 and 13 with four AIM-120A or AIM-120B style missiles loaded thereon.

As shown in FIG. 15, even when four AIM-120A or AIM-120B missiles 34 are mounted on rails 40, 44, 46, and 50, the overall width W is occupied by the missiles is 86 inches and yet four inches of clearance is provided for the DLA antenna mast between the missiles on rails 44 and 46.

Returning now to FIGS. 12 and 13, rear wall 100 of platform is 38.5 inches long with center section 110 28 inches long and 1.25 inches high while outer sections 112 and 114 are each 9.88 inches long and 3 inches high. Front wall 116 is 72.12 inches long and 3 inches high. Side walls 120 and 122 are 36.44 inches long and 3 inches high. Corner sections 124 and 126 are each 17.22 inches long and 3 inches high. Mounting pads 82*a*, 86*a*, 88*a*, and 92*a* are each 3.75 inches long 3.65 inches wide and 0.13 inches high above top plate 140 which is 0.19 inches thick. Mounting pads 82*b*, 86*b*, 88*b*, and 92*b* are each 49.3 inches long, 3.65 inches wide and 0.13 inches high above top plate 140. The distance between bolt holes 94*a* and 94*b* is 30 inches. Mounting pads 84*a*, 84*b*, 90*a*, and 90*b* each have rear wall 150 as shown for pad 90*a* 2.63 inches high above top plate 140, 3.62 inches wide. Side wall 152 is 2.63 inches high, 3.3 inches wide, and 0.19 inches thick. Side wall 154 is 2.63 inches high, 1.28 inches wide, and 0.19 inches thick. The radius of curvature of front portion 156 is 1.315. Top surface 158 is 0.19 inches thick. Rear wall 150 of mounting pads 84*b* and 90*b* is 1.655 inches from rear wall 100 of platform 38. Rear wall 150 of mounting pads of 84*a* and 90*a* is 31.655 inches from rear wall of platform 38. The center line through the bolt holes of pad 92*a* and 92*b* is 11.75 inches from the center line through the bolt holes of pads 90*a* and 90*b*. The center line through the bolt holes of pads 90*a* and 90*b* is 11.75 inches from the center line through the bolt holes of pads 88*a* and 88*b*.

This specific design, however, is directed to compliance with the constraints imposed by the U.S. military with respect to the HUM-V vehicle and the AMRAAM model missiles. Modifications of these dimensions for other types of transport vehicles and/or other types of missiles will be understood by those skilled in the art and are within the scope of this invention.

In any embodiment, launcher platform 38, FIGS. 12 and 13 is much more versatile than the launcher support platforms associated with the prior art. Launcher platform 38 can accommodate more missiles and different model missiles meeting both the firepower requirements and the inventory requirements of the United States military and the militaries of foreign governments. Launcher platform 38 has a low center of gravity and is designed to meet certain predefined weight, width, and length requirements thereby insuring both maximum firepower and mobility. As shown in FIGS. 3–5, the launcher support platform of the subject invention can accommodate two AIM-120A or AIM-120B model missiles and three AIM-120C model missiles. As shown in FIGS. 6–8, the same launcher platform can accommodate six AIM-120C model missiles. As shown in FIGS. 9–11, the same launcher platform can accommodate four AIM-120A, four AIM-120B, or four AMRAAM extended range missiles.

The unique launcher support platform of this invention does not interfere with the launch vehicle's mobility nor does it interfere with the launch vehicle when the launch platform is elevated and/or rotated. Launcher platform 38, FIGS. 12 and 13 also facilitates easier installation of the fins on the missiles. Moreover, since it is monolithic in construction, it can be reliably produced by casting techniques.

Accordingly, the launcher platform of the subject invention can accommodate additional missiles thus supporting a higher firepower capability and can also accommodate missiles of different configurations and yet, at the same time, is designed to maintain a low center of gravity and to meet certain predefined weight, width, and length requirements. These features are effected by elevating the intermediate rails above the rails adjacent to them to a height where the fins of the missiles on the rails are interleaved and also by offsetting the elevated rails rearwardly so that the fins can be installed more easily on the missiles and also so that the fins of the outer most missiles do not interfere with anything as the launcher platform is elevated and/or rotated. As stated above, one design goal of the subject invention is to accommodate as many AIM-120C model missiles as possible (for example six at fixed sites or during low mobility requirements and five during high mobility requirements) since, in the future, these types of missiles will be the most prevalent. At the same time, the launcher platform of the subject invention can also accommodate as many AIM-120A and/or AIM-120B style missiles as possible (in some cases in conjunction with AIM-120C and/or extended range missiles) since the United States Marine Corps, for example, still has these missiles in inventory.

Note that specific features of this invention are shown in some drawings but not in others. This is for convenience only as each feature may be combined with any or all of the other features in accordance with the invention. Moreover, the words "including", "comprising", "having", and "with" as used herein are to be interpreted broadly and comprehensively and are not limited to any physical interconnection. Also, any specific embodiments or dimensions disclosed herein are not to be taken as the only possible embodiments. Other embodiments will occur to those skilled in the art and are within the following claims.

What is claimed is:

1. A launcher platform comprising:

a support structure structured and arranged to be elevated and rotated and including a top plate; and a plurality of rails mounted on the support structure for supporting missiles thereon, including selected rails elevated above the other rails to accommodate additional missiles and different type missiles while maintaining a low center of gravity, each selected rail offset rearwardly from the other rails.

2. The launcher platform of claim 1 in which there are six rails total, three on each side of the support structure, and the intermediate rails on each side are elevated above the other rails.

3. The launcher platform of claim 1 in which there are N total rails where N is an even number, N/2 rails on each side of the support structure, and the minority of the rails are elevated.

4. The launcher platform of claim 1 in which there are six rails total, three on each side of the support structure, and the intermediate rails on each side are elevated above and offset rearwardly from the other rails.

5. The launcher platform of claim 1 in which there are N rails total where N is an even number, N/2 rails on each side of the support structure, and the minority of the rails are offset from the other rails.

6. The launcher platform of claim 1 in which the support structure is a monolithic platform.

7. The launcher platform of claim 6 in which the monolithic platform includes a set of mounting pads for each rail.

8. The launcher platform of claim 7 in which the mounting pads are cast as a part of the platform.

9. The launcher platform of claim 6 in which the platform has a predetermined width and a predefined length.

10. The launcher platform of claim 6 in which the platform is made of aluminum.

11. The launcher platform of claim 6 in which the platform is made of a composite material.

12. The launcher platform of claim 6 in which the platform has a center line and the rails are symmetrically arranged with respect to the center line of the platform.

13. A launcher platform comprising:

a support structure structured and arranged to be elevated and rotated and including a top plate; and a plurality of rails on each side of the support structure, at least one rail on each side elevated above the other rails and offset rearwardly from the other rails to accommodate additional missiles and different type missiles.

14. The launcher platform of claim 13 in which there are N rails total where N is an even number, N/2 rails on each side of the support structure, and the minority of the rails on each side are elevated.

15. The launcher platform of claim 13 in which at least one rail is offset from the other rail or rails.

16. A launcher platform comprising:

a monolithic platform support structure; and a plurality of rails mounted on the monolithic platform support structure for supporting missiles thereon, the monolithic platform support structure including a set of mounting pads for each rail, selected rails elevated above the other rails to accommodate additional missiles and different type missiles while maintaining a low center of gravity.

17. The launcher platform of claim 16 in which the mounting pads are cast as a part of the platform.

18. The launcher platform of claim 16 in which there are six rails total, three on each side of the monolithic platform support structure, and the intermediate rails on each side are elevated above the other rails.

19. The launcher platform of claim 16 in which there are N total rails where N is an even number, N/2 rails on each side of the support structure, and the minority of the rails are elevated.

20. The launcher platform of claim 16 in which adjacent rails are offset from the other rails.

21. The launcher platform of claim 20 in which the offset rails are offset rearwardly from the other rails.

22. The launcher platform of claim 20 in which the elevated rails are offset from the other rails.

23. The launcher platform of claim 20 in which there are six rails total, three on each side of the monolithic platform support structure, and the intermediate rails on each side are elevated above and offset rearwardly from the other rails.

24. The launcher platform of claim 20 in which there are N rails total where N is an even number, N/2 rails on each side of the monolithic platform support structure, and the minority of the rails are offset from the other rails.

25. The launcher platform of claim 16 in which the monolithic platform support structure has a predetermined width and a predefined length.

26. The launcher platform of claim 16 in which the monolithic platform support structure is made of aluminum.

27. The launcher platform of claim 16 in which the monolithic platform support structure is made of a composite material.

28. The launcher platform of claim 16 in which the monolithic platform support structure has a center line and the rails are symmetrically arranged with respect to the center line of the platform.

29. A launcher platform comprising:

a monolithic platform support structure; and a plurality of rails mounted on the support structure for supporting missiles thereon, the monolithic platform support structure including a set of mounting pads for each rail with selected rails elevated above and offset rearwardly from the other rails to accommodate additional missiles and different type missiles while maintaining a low center of gravity.

30. A launcher platform comprising:

a platform support structure configured and arranged to be mounted on a launch vehicle and to be elevated and rotated relative to the launch vehicle and including a top plate; and a plurality of rails disposed on the platform support structure to support missiles thereon having at least one rail elevated above the other rails.

31. A launcher platform comprising:

a platform support structure configured and arranged to be mounted on a launch vehicle and to be elevated and rotated relative to the launch vehicle and including a top plate; and a plurality of rails disposed on the platform support structure to support missiles thereon having at least one rail offset rearwardly from the other rails.

32. A launcher platform comprising:

a monolithic platform support structure; and a plurality of rails disposed on the support structure to support missiles thereon having at least one rail elevated above the other rails, the monolithic platform support structure including a set of mounting pads for each rail.

33. A launcher platform comprising:

a monolithic platform support structure; and a plurality of rails disposed on the support structure to support missiles thereon having at least one rail offset rearwardly from the other rails, the monolithic platform support structure including a set of mounting pads for each rail.

34. A launcher platform comprising:

a support structure structured and arranged to be elevated and rotated and including a top plate, the support structure mounted on an HMMWV vehicle; and a plurality of rails mounted on the support structure for supporting missiles thereon, selected rails elevated above the other rails to accommodate additional missiles and different type missiles while maintaining a low center of gravity.

35. A launcher platform comprising:

a support structure structured and arranged to be elevated and rotated and including a top plate, the support structure mounted on an HMMWV vehicle; and a plurality of rails mounted on the support structure for supporting missiles thereon, selected rails offset rearwardly from the other rails to accommodate additional missiles and different type missiles while maintaining a low center of gravity.

* * * * *